US011228134B2

(12) United States Patent
Yasuda et al.

(10) Patent No.: US 11,228,134 B2
(45) Date of Patent: Jan. 18, 2022

(54) COVER MEMBER FOR CABLE CONNECTOR, CABLE CONNECTOR DEVICE USING THE SAME, AND CABLE CONNECTOR DEVICE ASSEMBLING METHOD

(71) Applicant: HIROSE ELECTRIC CO., LTD., Yokohama (JP)

(72) Inventors: Makoto Yasuda, Yokohama (JP); Kenichi Naganuma, Yokohama (JP)

(73) Assignee: HIROSE ELECTRIC CO., LTD., Yokohama (JP)

( * ) Notice: Subject to any disclaimer, the term of this patent is extended or adjusted under 35 U.S.C. 154(b) by 0 days.

(21) Appl. No.: 16/919,640

(22) Filed: Jul. 2, 2020

(65) Prior Publication Data

US 2021/0013667 A1 Jan. 14, 2021

(30) Foreign Application Priority Data

Jul. 9, 2019 (JP) ..... JP2019-127407

(51) Int. Cl.
*H01R 13/516* (2006.01)
*H01R 13/506* (2006.01)
(Continued)

(52) U.S. Cl.
CPC ..... *H01R 13/516* (2013.01); *H01R 13/506* (2013.01); *H01R 43/20* (2013.01); *H01R 24/60* (2013.01)

(58) Field of Classification Search
CPC ..... H01R 13/516; H01R 13/506; H01R 13/6272; H01R 43/20; H01B 24/60
See application file for complete search history.

(56) References Cited

U.S. PATENT DOCUMENTS 6,234,840 B1 * 5/2001 Nakata ..... H01R 13/6593 439/607.01
6,962,504 B2 * 11/2005 Fukui ..... H01R 13/562 439/466
(Continued)

FOREIGN PATENT DOCUMENTS

EP 3422489 A1 1/2019
JP 2001-143812 A 5/2001
(Continued)

OTHER PUBLICATIONS

Extended European Search Report (EESR) dated Aug. 18, 2020 for the corresponding European Patent Application No. 20184295.2.
(Continued)

*Primary Examiner* — Oscar C Jimenez
(74) *Attorney, Agent, or Firm* — Rankin, Hill & Clark LLP

(57) ABSTRACT

A cover member includes a first cover part and a second cover part. The first cover part includes: a mount surface on which a main body of a cable connector is mounted; a periphery wall which is provided to lie substantially along an outer edge of the main body of the cable connector mounted on the mount surface and which is raised from the mount surface toward a side on which the first cover part is combined with the second cover part; a cable outlet and a connection port; an engaging portion that engages with a predetermined portion of the second cover part; and a pair of raised portions raised from the mount surface toward the side on which the first cover part is combined with the second cover part, the pair of raised portions being provided at positions which sandwich a cable extending out from the main body of the cable connector mounted on the mount surface and which are at or near the cable outlet.

12 Claims, 11 Drawing Sheets

(51) Int. Cl.
*H01R 43/20* (2006.01)
*H01R 24/60* (2011.01)

(56) References Cited

U.S. PATENT DOCUMENTS

| | | | | |
|---|---|---|---|---|
| 6,997,749 | B1 * | 2/2006 | Harubayashi | H01R 13/506 439/353 |
| 7,021,959 | B2 | 4/2006 | Tsuji et al. | |
| 7,815,460 | B2 * | 10/2010 | Lin | H01R 9/03 439/358 |
| 8,894,441 | B2 * | 11/2014 | Wu | H01R 13/6471 439/607.01 |
| 9,246,257 | B2 * | 1/2016 | Shimoyasu | H01R 13/516 |
| 9,461,400 | B2 | 10/2016 | Kanda et al. | |
| 10,236,628 | B2 * | 3/2019 | Motohashi | H01R 12/716 |
| 10,249,976 | B1 * | 4/2019 | Thomas | H01R 13/506 |
| 2001/0046809 | A1 * | 11/2001 | Chiran | H01R 13/6593 439/607.48 |
| 2001/0049225 | A1 * | 12/2001 | Chiran | H01R 13/506 439/582 |
| 2004/0102082 | A1 | 5/2004 | Tsuji et al. | |
| 2008/0280467 | A1 * | 11/2008 | Tsuji | H01R 13/567 439/135 |
| 2013/0130549 | A1 | 5/2013 | Wu et al. | |
| 2016/0204543 | A1 | 7/2016 | Kanda et al. | |
| 2019/0058289 | A1 | 2/2019 | Sakaizawa et al. | |

FOREIGN PATENT DOCUMENTS

| | | | |
|---|---|---|---|
| JP | 2002-170626 | A | 6/2002 |
| JP | 2004-220856 | A | 8/2004 |
| JP | 3114986 | U | 11/2005 |
| JP | 2012-9747 | A | 1/2012 |
| JP | 2016-131113 | A | 7/2016 |
| JP | 2017-10754 | A | 1/2017 |

OTHER PUBLICATIONS

Japanese Office Action (JPOA) dated Nov. 29, 2021 for corresponding Japanese Patent Application No. 2019-127407 and its English machine translation.

* cited by examiner

COVER MEMBER FOR CABLE CONNECTOR, CABLE CONNECTOR DEVICE USING THE SAME, AND CABLE CONNECTOR DEVICE ASSEMBLING METHOD

CROSS-REFERENCE TO RELATED APPLICATION

This application claims priority from Japanese Patent Application No. 2019-127407 filed with the Japan Patent Office on Jul. 9, 2019, the entire content of which is hereby incorporated by reference.

BACKGROUND

1. Technical Field

One aspect of the present disclosure relates to a cover member, and further relates to a cover member for cable connector, a cable connector device using the same, and a cable connector device assembling method.

2. Related Art

JP-A-2002-170626 discloses one example of cover members and the like. The cover member disclosed in JP-A-2002-170626 includes a base case and a cover case. In the cover member, the inner space surrounded by the base case and the cover case houses an inner housing. A wire of a cable introduced into the inner space, and a terminal mounted inside the inner housing are connected.

The inner housing is elastically mounted on the base case. When the inner housing is mounted, an engaging protrusion provided on the side wall of the inner housing engages with an engaging protrusion provided on the side wall of the base case. This engagement keeps the inner housing mounted on the base case.

After the inner housing is mounted on the base case, a cable clamp is set on a fixation base at the cable-introducing end of the base case, and screwed onto the fixation base. This screwing fixes a cable.

In this configuration, the inner housing is held at a predetermined mount position of the base cover by the engagement between the engaging protrusions. Because of this, even in a case where external force is transmitted to the inner housing due to the placement of the cable, vibrations of the base cover, or the like until the cable is fixed, it is less likely that the inner housing is forced out of its mount position due to floating or the like.

SUMMARY

A cover member includes a first cover part and a second cover part. The first cover part includes: a mount surface on which a main body of a cable connector is mounted; a periphery wall which is provided to lie substantially along an outer edge of the main body of the cable connector mounted on the mount surface and which is raised from the mount surface toward a side on which the first cover part is combined with the second cover part; a cable outlet and a connection port that are provided as cutout portions of the periphery wall; an engaging portion that engages with a predetermined portion of the second cover part when the first cover part and the second cover part are combined together; and a pair of raised portions that is raised from the mount surface toward the side on which the first cover part is combined with the second cover part, the pair of raised portions being provided at positions which sandwich a cable extending out from the main body of the cable connector mounted on the mount surface and which are at or near the cable outlet. An exit direction that lies along a direction of the cable that exits through the cable outlet, and a connection direction that lies along a direction of a counterpart connector to be connected with the main body of the cable connector through the connection port cross each other at the first cover part.

DETAILED DESCRIPTION

Figure 1:
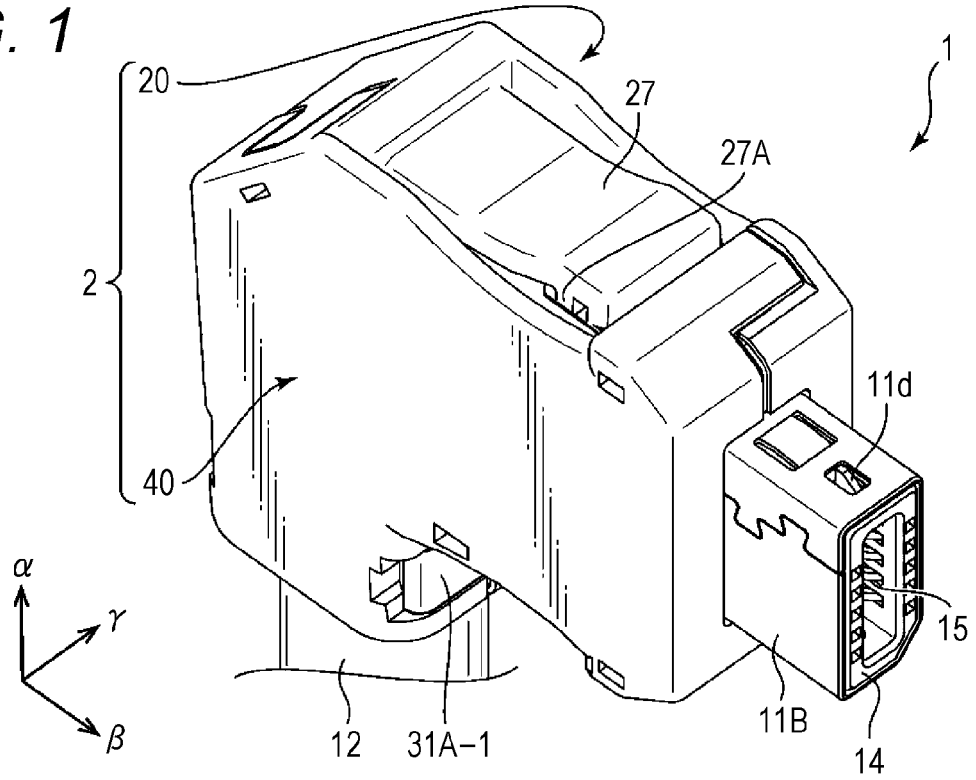
FIG. 1 is a perspective view of a cable connector device which is a cable connector having a cover member according to one embodiment of the present disclosure attached thereto.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to the configuration disclosed in JP-A-2002-170626, a cable is screwed onto a base case. Because of this, it is possible to think that there is a low possibility of occurrence of positional misalignment of the cable relative to the base case or loosening of the fixation of the inner housing to the base case due to external force generated through the cable at the time of the placement of the cable or the like.

However, the cable is fixed to the base case separately from the inner housing, and moreover by screwing. Because of this, the work for fixation of the cable is very cumbersome, resulting in less productivity.

One object in the present disclosure is to provide a cover member for cable connector, a cable connector device using the same, and a cable connector device assembling method that are capable of overcoming the drawbacks of typical technologies described above.

A cover member according to one aspect of the present disclosure (the present cover member) includes a first cover part and a second cover part. The first cover part includes: a mount surface on which a main body of a cable connector is mounted; a periphery wall which is provided to lie substantially along an outer edge of the main body of the cable connector mounted on the mount surface and which is raised from the mount surface toward a side on which the first cover part is combined with the second cover part; a cable outlet and a connection port that are provided as cutout portions of the periphery wall; an engaging portion that engages with a predetermined portion of the second cover part when the first cover part and the second cover part are combined together; and a pair of raised portions that is raised from the mount surface toward the side on which the first cover part is combined with the second cover part, the pair of raised portions being provided at positions which sandwich a cable extending out from the main body of the cable connector mounted on the mount surface and which are at or near the cable outlet. An exit direction that lies along a direction of the cable that exits through the cable outlet, and a connection direction that lies along a direction of a counterpart connector to be connected with the main body of the cable connector through the connection port cross each other at the first cover part.

According to the present cover member in this aspect, for example, a periphery wall is provided in a first cover part. The periphery wall makes the main body of a cable connector held stably by the first cover part. In addition, a pair of raised portions is provided as part of the first cover part. The pair of raised portions allows effective reduction of wobbling of a cable simply by combining the first cover part and a second cover part together.

Furthermore, a cable connector device according to one aspect of the present disclosure has the cable connector, and the present cover member provided to the cable connector.

In the present cover member, part of the engaging portion may be formed as the pair of raised portions.

Moreover, in the present cover member, the pair of raised portions may be provided continuously with the periphery wall from the mount surface toward the side on which the first cover part is combined with the second cover part.

Furthermore, in the present cover member, the pair of raised portions preferably has engaging protrusions which protrude toward opposite sides of the pair of raised portions, respectively, and which engage with predetermined portions of the second cover part, the engaging protrusions being provided on the side on which the first cover part is combined with the second cover part.

Further, in the present cover member, it is preferable that an elastic movable piece that manipulates a movable engaging portion that engages with a predetermined portion of the counterpart connector when the cable connector is connected with the counterpart connector be provided to the main body of the cable connector, and part of the periphery wall where the elastic movable piece is positioned when the main body of the cable connector is mounted on the mount surface be formed as a cantilever-like elastic piece that manipulates the elastic movable piece.

Moreover, in the present cover member, the cantilever-like elastic piece may be provided on external-angle side of a crossing portion of the exit direction and the connection direction such that the cantilever-like elastic piece lies along the connection direction.

Moreover, in the present cover member, the engaging portion may include: an engaging element provided near the cable outlet; an engaging element provided diagonally on an external-angle side of a crossing portion of the exit direction and the connection direction; engaging elements that are provided on an internal-angle side of the crossing portion such that the engaging elements lie along the connection direction; and an engaging element that is provided on the external-angle side of the crossing portion such that the engaging element lies along the connection direction.

Further, in the present cover member, it is preferable that a plurality of abutting portions abut against the main body of the cable connector when the main body of the cable connector is mounted on the mount surface, the plurality of abutting portions being provided in a gap that is formed, in a surface direction of the mount surface, between the periphery wall and the main body of the cable connector mounted on the mount surface.

Moreover, in the present cover member, the abutting portions preferably include at least any one of: a first abutting portion provided diagonally on an external-angle side of a crossing portion of the exit direction and the connection direction; a second abutting portion provided on an internal-angle side of the crossing portion such that the second abutting portion lies along the connection direction; and a third abutting portion provided on the external-angle side of the crossing portion such that the third abutting portion lies along the connection direction.

Furthermore, in the present cover member, it is preferable that the abutting portions have abutting surfaces that abut against the main body of the cable connector mounted on the mount surface, and when the first cover part and the second cover part are combined together, the abutting surfaces of the abutting portions form a surface substantially continuous with the main body of the cable connector together with corresponding abutting surfaces of corresponding abutting portions provided to the second cover part.

Moreover, a method of assembling a cable connector device according to one aspect of the present disclosure (the present assembling method) includes: mounting a main body of a cable connector on a mount surface of a first cover part, and sandwiching, with a pair of raised portions raised from the mount surface toward a side on which the first cover part is combined with a second cover part, a cable that extends out from the main body of the cable connector mounted on the mount surface; and combining the first cover part with the second cover part, and causing the first cover part and the second cover part to engage with each other.

The present assembling method may further include: positioning, relative to the first cover part, the main body of the cable connector by using a periphery wall, the periphery wall being provided to lie substantially along an outer edge of the main body of the cable connector mounted on the mount surface when the main body of the cable connector is mounted on the mount surface, the periphery wall being raised from the mount surface toward the side on which the first cover part is combined with the second cover part; and causing the main body of the cable connector to abut against a plurality of abutting portions that fill a gap generated between the periphery wall and the main body of the cable connector mounted on the mount surface.

According to the aspect described above of the present disclosure, a cover member for cable connector, a cable connector device using the same, and a cable connector device assembling method that are capable of overcoming the drawbacks of typical devices described above are provided.

Hereinafter, one suitable embodiment of the present disclosure is explained with reference to the attached drawings. For convenience of description, only a suitable embodiment is illustrated. It should be noted, however, that this certainly does not limit the technology of the present disclosure.

Figure 2:
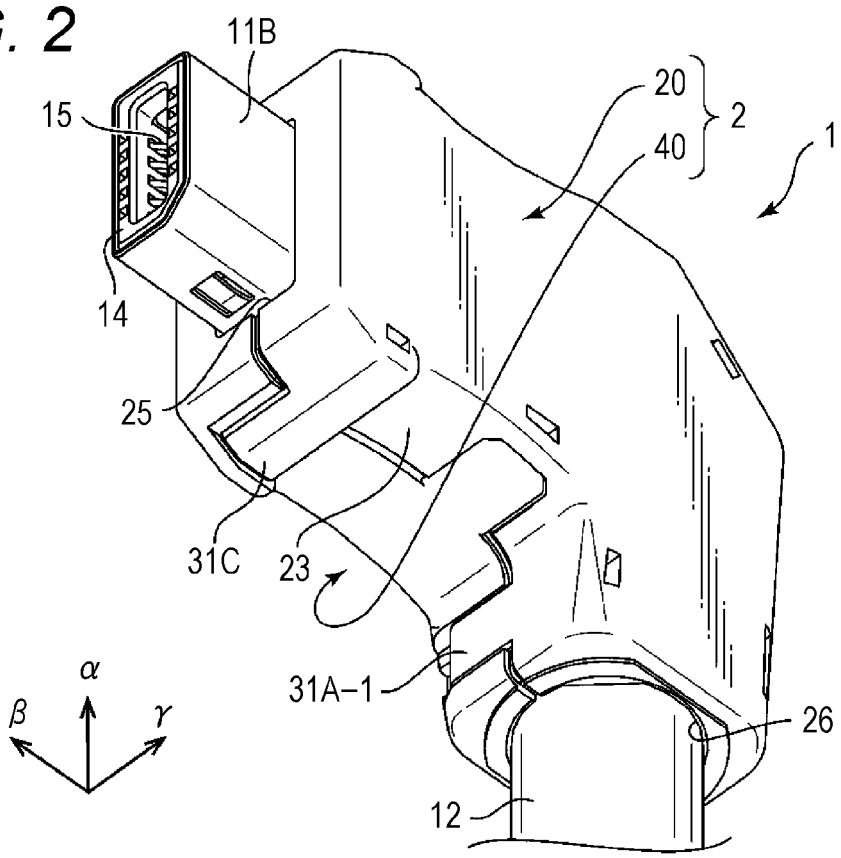
FIG. 2 is a perspective view of the cable connector device which is the cable connector having the cover member according to the one embodiment of the present disclosure attached thereto.
Figure 3:
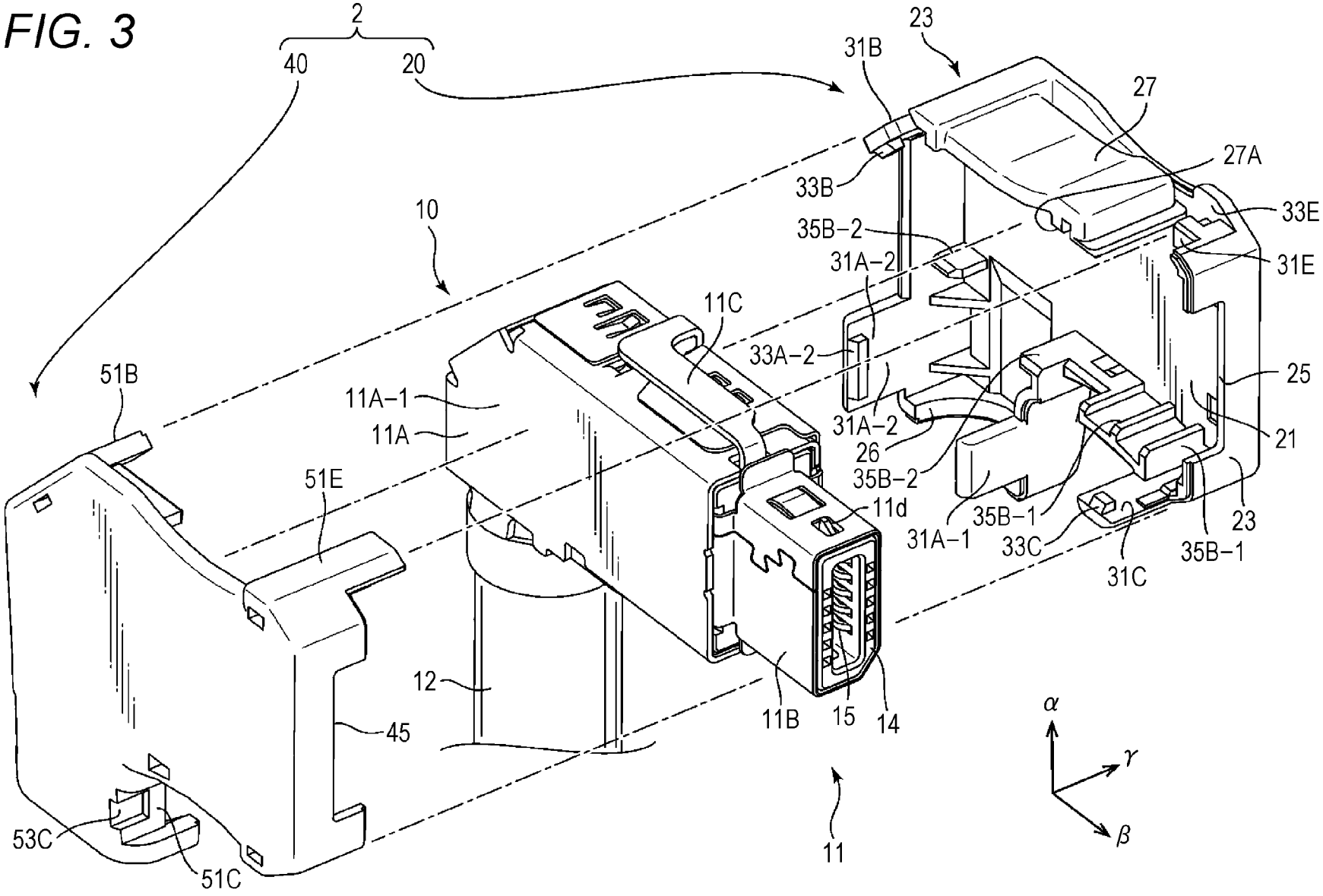
FIG. 3 is an exploded perspective view of the cable connector device illustrated in FIG. 1.
Figure 4:
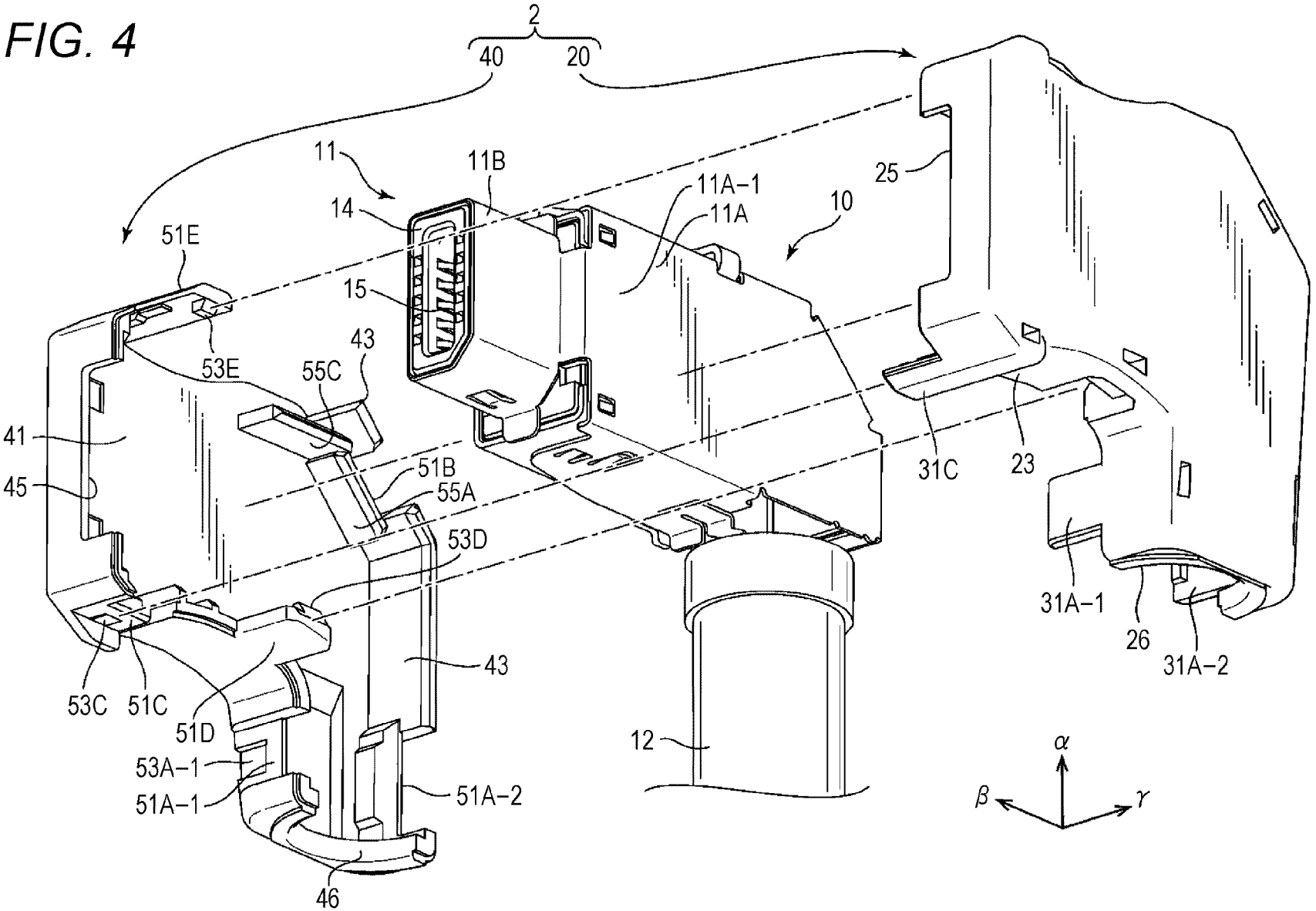
FIG. 4 is an exploded perspective view of the cable connector device illustrated in FIG. 2.

Both FIG. 1 and FIG. 2 are perspective views of a cable connector device 1 according to one embodiment of the present disclosure, i.e., a cable connector 11 having a cover member 2 attached thereto. FIG. 1 and FIG. 2 illustrate the cable connector device 1 from mutually different angles. FIG. 3 and FIG. 4 are each an exploded perspective view of the cable connector device 1 illustrated in FIG. 1 and FIG. 2. The cable connector 11 is used in a state in which the cable connector 11 is fixed to one end of a cable 12, and extends along direction "α".

The cable connector 11 mainly includes a terminal 15, a housing 14 that holds the terminal 15, and furthermore a metal shell 10 that covers the outside of the housing 14. The metal shell 10 includes, for example, a main body 11A having an approximately rectangular-parallelepiped shape, a fitting portion 11B and an elastic movable piece 11C. The main body 11A is the main body of the cable connector 11. The fitting portion 11B protrudes from the main body 11A along fitting direction "β" toward the side on which the cable connector 11 fits with a counterpart connector (not illustrated). The elastic movable piece 11C is provided as a cantilever-like member on an upper side surface of the main body 11A such that the elastic movable piece 11C is movable along direction "α".

The fitting portion 11B is used as a portion to be fit to a predetermined portion of the counterpart connector when the cable connector 11 is connected with the counterpart connector. On the upper and lower surfaces of the fitting portion 11B, movable engaging portions 11*d* are provided as members elastically protruding from the fitting portion 11B. The movable engaging portions 11*d* engage with predetermined portions of the counterpart connector, and make the fitting portion 11B held by the counterpart connector.

The movable engaging portion 11*d* is formed at one end of the elastic movable piece 11C. The movable engaging portion 11*d* can be manipulated via the elastic movable piece 11C relative to the fitting portion 11B along direction "α". The movable engaging portion 11*d* is always urged by the elastic movable piece 11C such that the movable engaging portion 11*d* protrudes outward from the fitting portion 11B. Regarding this, for example, when fitting between the fitting portion 11B and the counterpart connector is to be undone, the elastic movable piece 11C is manipulated to move the movable engaging portion 11*d* to a position recessed in the fitting portion 11B. This movement can undo the engagement between the fitting portion 11B and the counterpart connector.

The cover member 2 includes a first cover part 20 and a second cover part 40. The first cover part 20 and the second cover part 40 are combined together by, for example, being coupled together in direction "γ" in a state in which the main body 11A of the metal shell 10 is sandwiched by the first cover part 20 and the second cover part 40.

Figure 5:
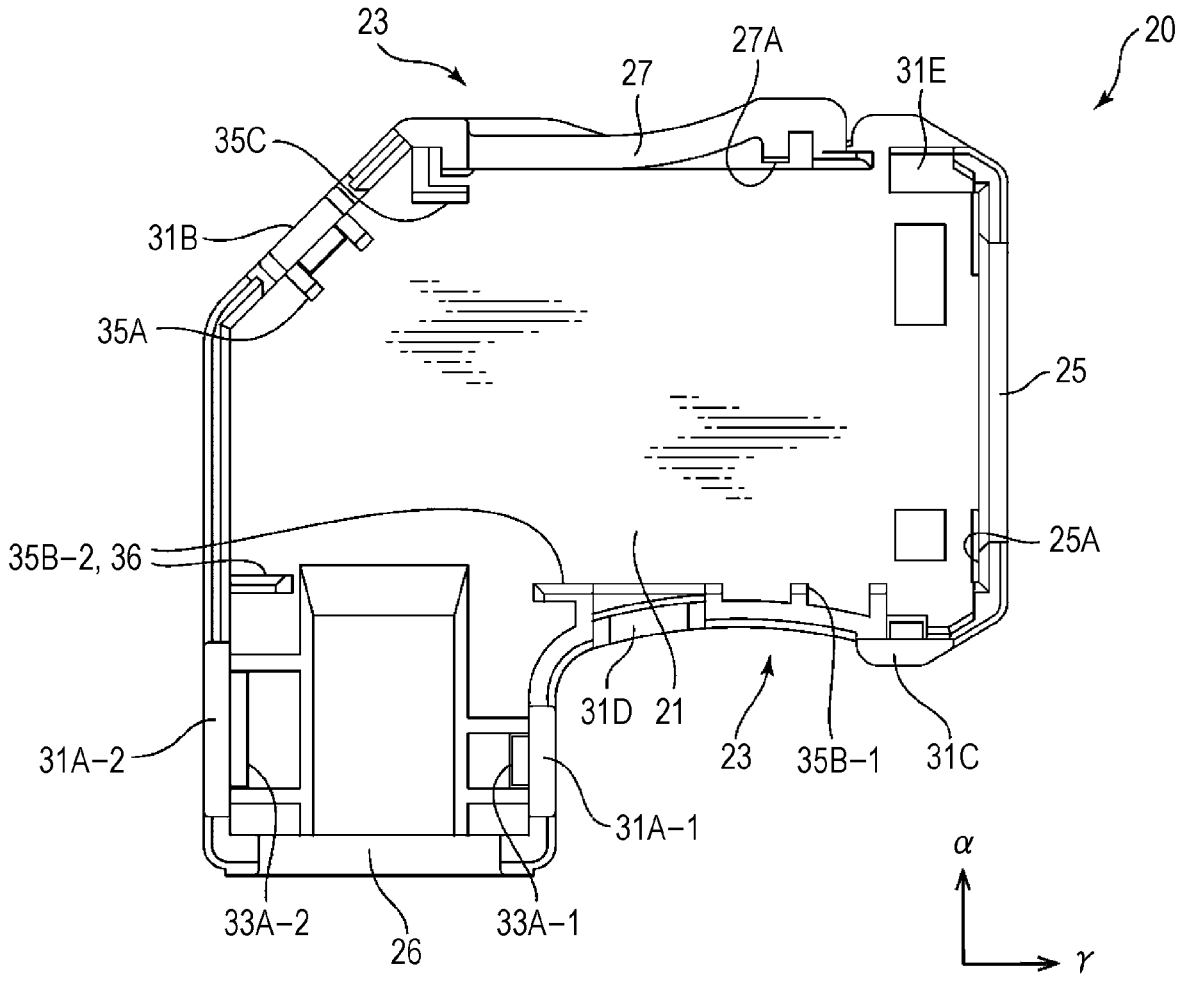
FIG. 5 is a plan view of an individual body diagram of a first cover part.
Figure 6:
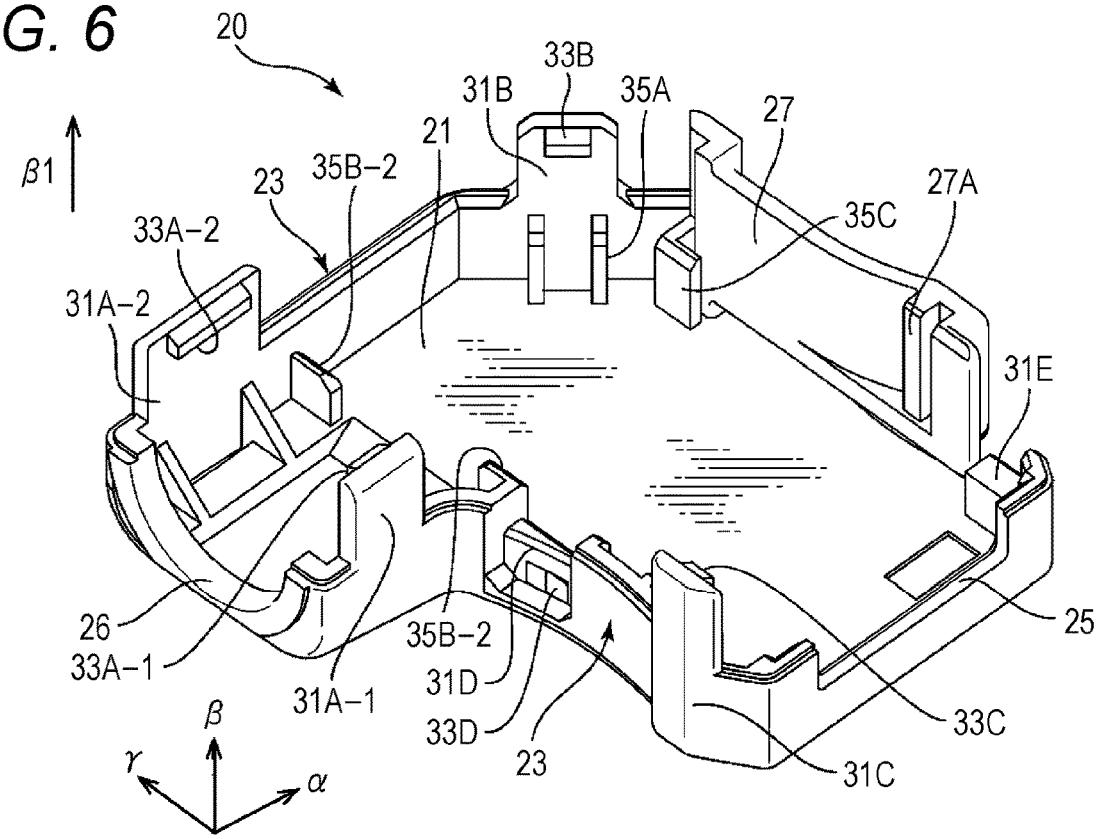
FIG. 6 is a perspective view of the individual body diagram of the first cover part.
Figure 7:
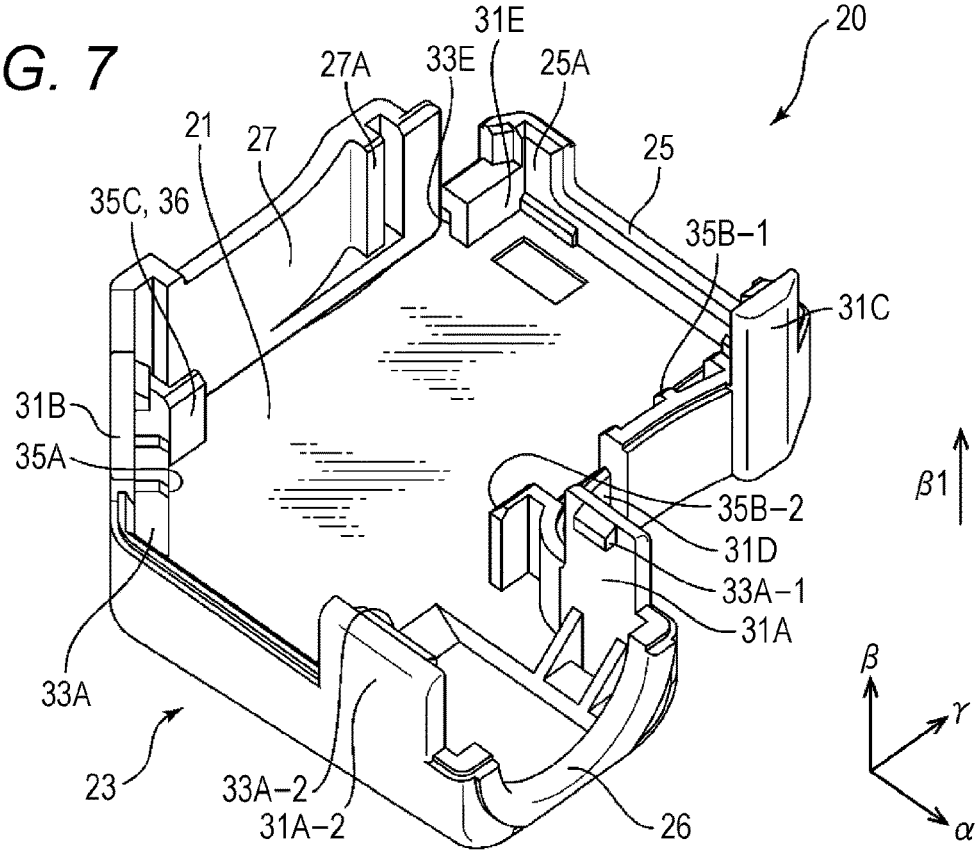
FIG. 7 is a perspective view of the individual body diagram of the first cover part.

FIG. 5 to FIG. 7 each illustrate an individual body diagram of the first cover part 20. FIG. 5 is a plan view of the first cover part 20, and FIG. 6 and FIG. 7 are perspective views of the first cover part 20. The first cover part 20 includes at least a mount surface 21, a periphery wall 23, a cable outlet 26, a connection port 25, a first engaging portion 31, and a pair of raised portions 31A-1 and 31A-2.

The mount surface 21 is an approximately flat inner surface of the first cover part 20. When the cable connector device 1 is assembled, first, the main body 11A of, for example, a side-surface portion 11A-1 of, the metal shell 10 is mounted on the mount surface 21.

The periphery wall 23 is formed on the mount surface 21. The periphery wall 23 is provided to lie substantially along the outer edge of the main body 11A mounted on the mount surface 21 in a state in which the periphery wall 23 is raised from the mount surface 21 in direction "β1" toward the side on which the first cover part 20 is combined with the second cover part 40. Here, "lying substantially along" means that the periphery wall 23 may lie along the outer edge of the main body 11A of the metal shell 10 only to such an extent that it is possible to position, relative to the first cover part 20, the cable connector 11, e.g., the main body 11A by using the periphery wall 23, and does not need to lie precisely along the entire outer edge of the main body 11A. By providing the periphery wall 23 to the first cover part 20, the main body 11A can be held at a predetermined portion of the first cover part 20. Accordingly, the main body 11A and the first cover part 20 can be positioned relative to each other.

By cutting out part of the periphery wall 23, i.e., as a cutout portion of the periphery wall 23, the cable outlet 26 is formed. The cable outlet 26 is used to allow the cable 12 connected to the cable connector 11 to exit to the outside of the cover member 2. Similarly, by cutting out part of the periphery wall 23, i.e., as a cutout portion of the periphery wall 23, the connection port 25 is formed. The connection port 25 is used to allow the fitting portion 11B, which is part of the metal shell 10 of the cable connector 11, to exit to the outside of the cover member 2. Here, exit direction "α" (hereinafter, simply referred to as the "exit direction") of the cable 12 to exit through the cable outlet 26, and connection direction "β" (hereinafter, simply referred to as the "connection direction") of the counterpart connector to be connected with the main body 11A through the connection port 25 cross each other at the first cover part 20. In the present embodiment, exit direction "α" and connection direction "β" cross approximately perpendicularly.

Part of the periphery wall 23 may be formed as a cantilever-like elastic piece 27. The elastic piece 27 is arranged at a portion where the elastic movable piece 11C provided on the metal shell 10 is positioned when the main body 11A is mounted on the mount surface 21. The elastic piece 27 is provided on the external-angle side of the crossing portion of exit direction "α" and connection direction "γ" such that the elastic piece 27 lies along connection direction "γ". The elastic piece 27 can be used to manipulate the elastic movable piece 11C. A pressing protrusion 27A is provided at the tip of the elastic piece 27. The pressing protrusion 27A protrudes toward the elastic movable piece 11C of the metal shell 10. By displacing the elastic piece 27 toward the elastic movable piece 11C, the pressing protrusion 27A of the elastic piece 27 can push the elastic movable piece 11C. This pressing can move the movable engaging portion 11*d* provided at the tip of the elastic movable piece 11C, and undo the engagement between the cable connector 11 and the counterpart connector.

When the main body 11A is mounted on the mount surface 21, a small gap 22 may be generated between the main body 11A and the periphery wall 23 in surface direction "a-γ" of the mount surface 21. In order to fill the gap 22, and make the main body 11A duly and precisely positioned at a predetermined position of the first cover part 20, a plurality of abutting portions 35 to abut against the main body 11A mounted on the mount surface 21 are provided at part of the gap 22.

Figure 8:
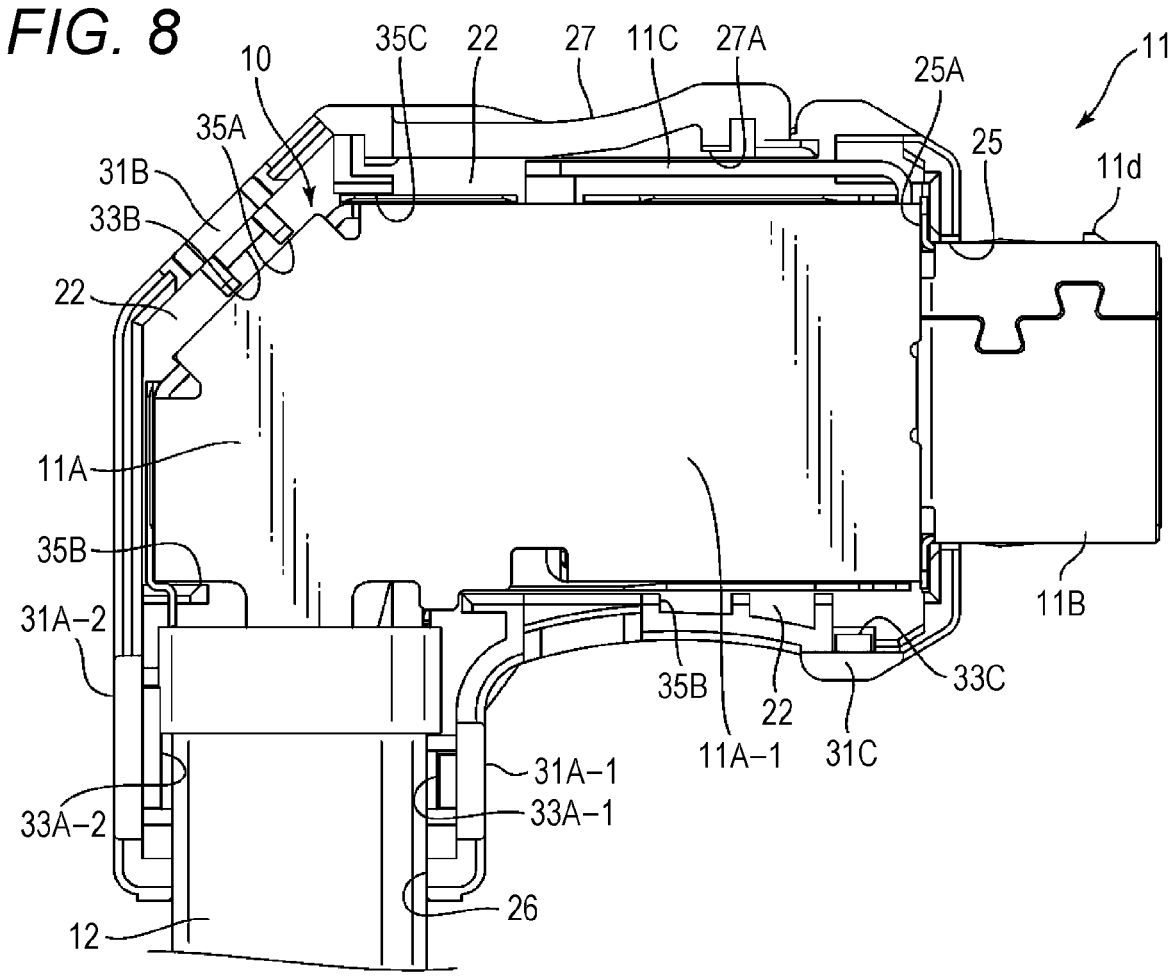
FIG. 8 is a plan view illustrating the state of the first cover part when the main body is mounted on a mount surface.
Figure 9:
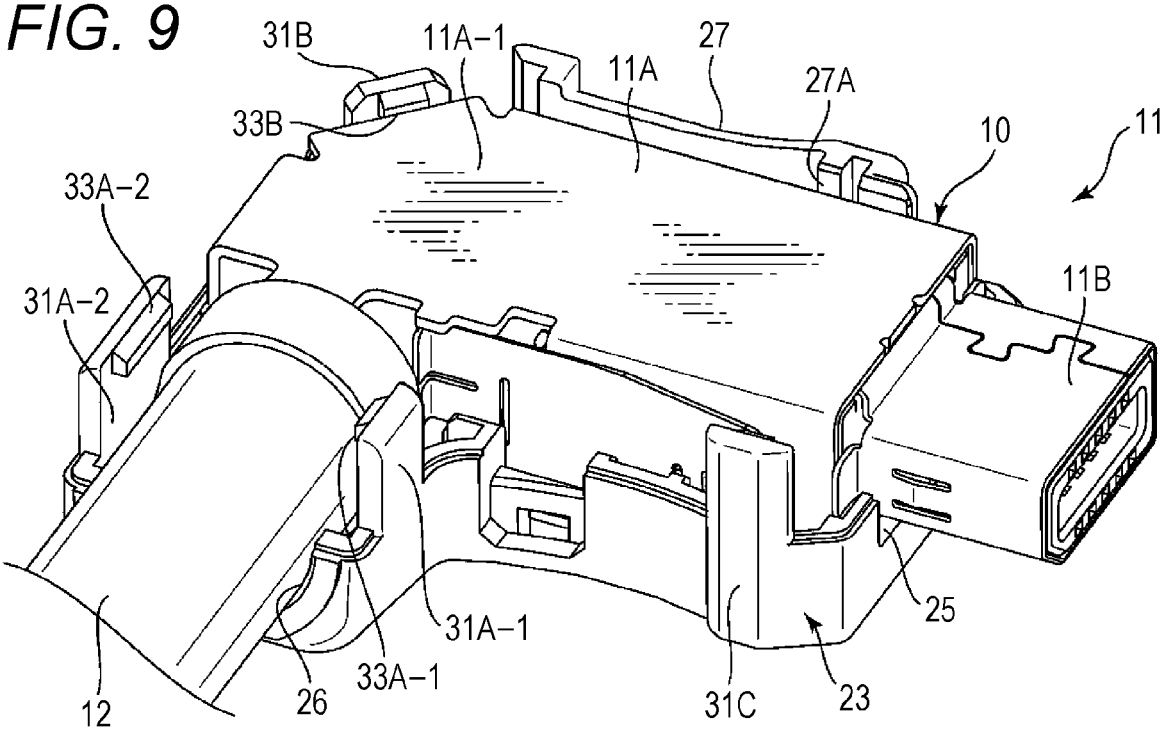
FIG. 9 is a perspective view illustrating the state of the first cover part when the main body is mounted on the mount surface.

FIG. 8 is a plan view illustrating the state of the first cover part 20 when the main body 11A is mounted on the mount surface 21, and FIG. 9 is a perspective view illustrating the same state. FIG. 8 corresponds to FIG. 5, and FIG. 9 corresponds to FIG. 6. As is apparent from these figures, the periphery wall 23 (including the elastic piece 27, and the pair of raised portions 31A-1 and 31A-2 in a case where these are formed as part of the periphery wall 23) provides a height (in direction "β1") of the first cover part 20 such that the height is sufficient to support the main body 11A. Accordingly, by providing the periphery wall 23 to the first cover part 20, the main body 11A is held stably by the first cover part 20. Furthermore, by providing the abutting portions 35 or the like, when the main body 11A is mounted on the mount surface 21, the main body 11A abuts against, for example, an inner-wall surface 25A of the connection port 25 and also abuts against those abutting portions 35. As a result, the main body 11A and furthermore the metal shell 10 are positioned duly relative to the first cover part 20. As a result, it is possible to reduce wobbling of the metal shell 10 relative to the first cover part 20 and furthermore to the cover member 2 due to external force generated through the cable at the time of the placement of the cable 12 or the like. Furthermore, by appropriately adjusting the positions at which the abutting portions 35 are provided, it is possible to duly fix the metal shell 10 and the cover member 2 to each other while reducing occurrences of wobbling between the metal shell 10 and the cover member 2 in whichever direction the cable connector 11 having the cover member 2 attached thereto is provided. Accordingly, for example, in a case where the cable 12 is arranged approximately perpendicularly, it is also possible to provide the metal shell 10 and the cover member 2 at the upper end of the cable 12, and it is also possible to provide the metal shell 10 and the cover member 2 at the lower end of the cable 12.

The abutting portions 35 include, for example: a first abutting portion 35A provided diagonally on the external-angle side of the crossing portion of exit direction "α" and connection direction "γ"; a second abutting portion 35B provided on the internal-angle side of the crossing portion and along the connection direction; and a third abutting portion 35C provided on the external-angle side of the crossing portion and along connection direction "γ".

The first abutting portion 35A is a rib-like member formed from the mount surface 21 along direction "β1" toward the side on which the first cover part 20 is combined with the second cover part 40.

The second abutting portion 35B includes: a second abutting portion 35B-1 provided closer to the connection port 25, and a pair of second abutting portions 35B-2 provided closer to the cable outlet 26. The second abutting portion 35B-1 is formed as a rib-like member, similarly to the first abutting portion 35A. On the other hand, the pair of second abutting portions 35B-2 is formed as relatively large tabular members along surface "β-γ".

Near the first abutting portion 35A, the third abutting portion 35C is formed as a relatively large tabular member along surface "β-γ", similarly to the second abutting portions 35B-2.

These abutting portions 35 may form abutting surfaces 36 between themselves and the main body 11A. For example, abutting surfaces 36 of the second abutting portion 35B-2 are illustrated in FIG. 5. In addition, an abutting surface 36 of the third abutting portion 35C is illustrated in FIG. 7.

The pair of raised portions 31A-1 and 31A-2 is also provided on the mount surface 21 in order to reduce wobbling of the cable 12 at the time of the placement of the cable 12 or the like. The pair of raised portions 31A-1 and 31A-2 that is raised from the mount surface 21 in direction "β1" toward the side on which the first cover part 20 is combined with the second cover part 40 is provided at positions which sandwich the cable 12 extending out from the main body 11A of the metal shell 10 mounted on the mount surface 21 and which are at or near the cable outlet 26. In the example illustrated in the present embodiment, the pair of raised portions 31A-1 and 31A-2 is provided near the cable outlet 26. Instead of this, the pair of raised portions 31A-1 and 31A-2 may be provided to include even the cable outlet 26, i.e., may be provided as the cable outlet 26. The raised portions 31A-1 and 31A-2 may be provided continuously with the periphery wall 23 as illustrated in the present embodiment. The raised portions 31A-1 and 31A-2 are provided as part of the first cover part 20. Because of this, simply by coupling the first cover part 20 and the second cover part 40 together, wobbling of the cable 12 can be reduced effectively. Accordingly, the work for screwing or the like is not required.

The first engaging portion 31 is also provided on the mount surface 21. The first engaging portion 31 engages with a predetermined portion of the second cover part 40 when the first cover part 20 and the second cover part 40 are combined together. By providing the first engaging portion 31, the first cover part 20 and the second cover part 40 can be kept coupled together.

The first engaging portion 31 includes, for example: an engaging element 31A provided near the cable outlet 26; an engaging element 31B provided diagonally on the external-angle side of the crossing portion of exit direction "α" and connection direction "γ"; engaging elements 31C and 31D provided on the internal-angle side of the crossing portion such that the engaging elements 31C and 31D lie along connection direction "γ"; and an engaging element 31E provided on the external-angle side of the crossing portion such that the engaging element 31E lie along connection direction "γ". Among these engaging elements, the engaging elements 31A, 31B and 31C are provided as members raised from the mount surface 21 in direction "β1". The tips of the raised sides of the engaging elements 31A, 31B and 31C are adjusted to reach substantially the same height positions in direction "β1" as the main body 11A of the metal shell 10 mounted on the mount surface 21, and as the elastic piece 27. By performing such height adjustment, it is possible to hold the metal shell 10 with the first cover part 20 in a favorable manner while suppressing size-increase of the device, and reducing damages to the engaging elements that may be caused by mistake.

The engaging element 31A, which is part of the first engaging portion 31, may be formed by using the pair of raised portions 31A-1 and 31A-2 as illustrated in the present embodiment, i.e., may be formed as the pair of raised portions 31A-1 and 31A-2. The engaging element 31A that is also the pair of raised portions 31A-1 and 31A-2 is provided near the cable outlet 26, the engaging element 31A being raised from the mount surface 21 in direction "β1" toward the side on which the first cover part 20 is combined with the second cover part 40. The raised portions 31A-1 and 31A-2 as the engaging element 31A have engaging protrusions 33A-1 and 33A-2, respectively, which protrude toward the opposite sides of the pair of raised portions 31A-1 and 31A-2 and which engage with predetermined portions of the second cover part 40. The engaging protrusions 33A-1 and 33A-2 are provided on the side on which the first cover part 20 is combined with the second cover part 40. By using these engaging protrusions 33A-1 and 33A-2, the first cover part 20 and the second cover part 40 can be kept coupled together. In this configuration, in particular, the engaging protrusions 33A-1 and 33A-2 are provided to protrude toward the opposite sides of the pair of raised portions 31A-1 and 31A-2, respectively. Because of this, for example, even in a case where the cable 12 collides with those raised portions 31A-1 and 31A-2, and the raised portions 31A-1 and 31A-2 are deformed at the time of the placement of the cable 12 or the like, either the engaging protrusion 33A-1 or 33A-2 provided on the raised portion 31A-1 or 31A-2 can maintain the engagement with a corresponding predetermined portion of the second cover part 40. Because of this, the first cover part 20 and the second cover part 40 can be kept coupled together more effectively.

Similarly to the pair of raised portions 31A-1 and 31A-2, the engaging element 31B is provided as a member raised from the mount surface 21 in direction "β1" toward the side on which the first cover part 20 is combined with the second cover part 40. In addition, the engaging element 31B has an engaging protrusion 33B on the side on which the first cover part 20 is combined with the second cover part 40. The engaging protrusion 33B engages with a predetermined portion of the second cover part 40 protruding toward the mount surface 21.

Similarly, the engaging element 31C is provided as a member raised from the mount surface 21 in direction "β1" toward the side on which the first cover part 20 is combined with the second cover part 40. In addition, the engaging element 31C has an engaging protrusion 33C on the side on which the first cover part 20 is combined with the second cover part 40. The engaging protrusion 33C engages with a predetermined portion of the second cover part 40 protruding toward the mount surface 21.

On the other hand, the engaging element 31D is formed as a member partially depressed in direction "β" that lies along direction "β1" in which the first cover part 20 is combined with the second cover part 40, and the engaging element 31D has a recessed engaging depression 33D. The counterpart second cover part 40 has a protrusion formed to be fit to the recessed engaging depression 33D such that the protrusion has a complementary relationship with the engaging depression 33D.

Similarly to the engaging element 31D, the engaging element 31E is formed as a member partially depressed in direction "β" that lies along direction "β1" in which the first cover part 20 is combined with the second cover part 40, and the engaging element 31E has a recessed engaging depression 33E.

Figure 10:
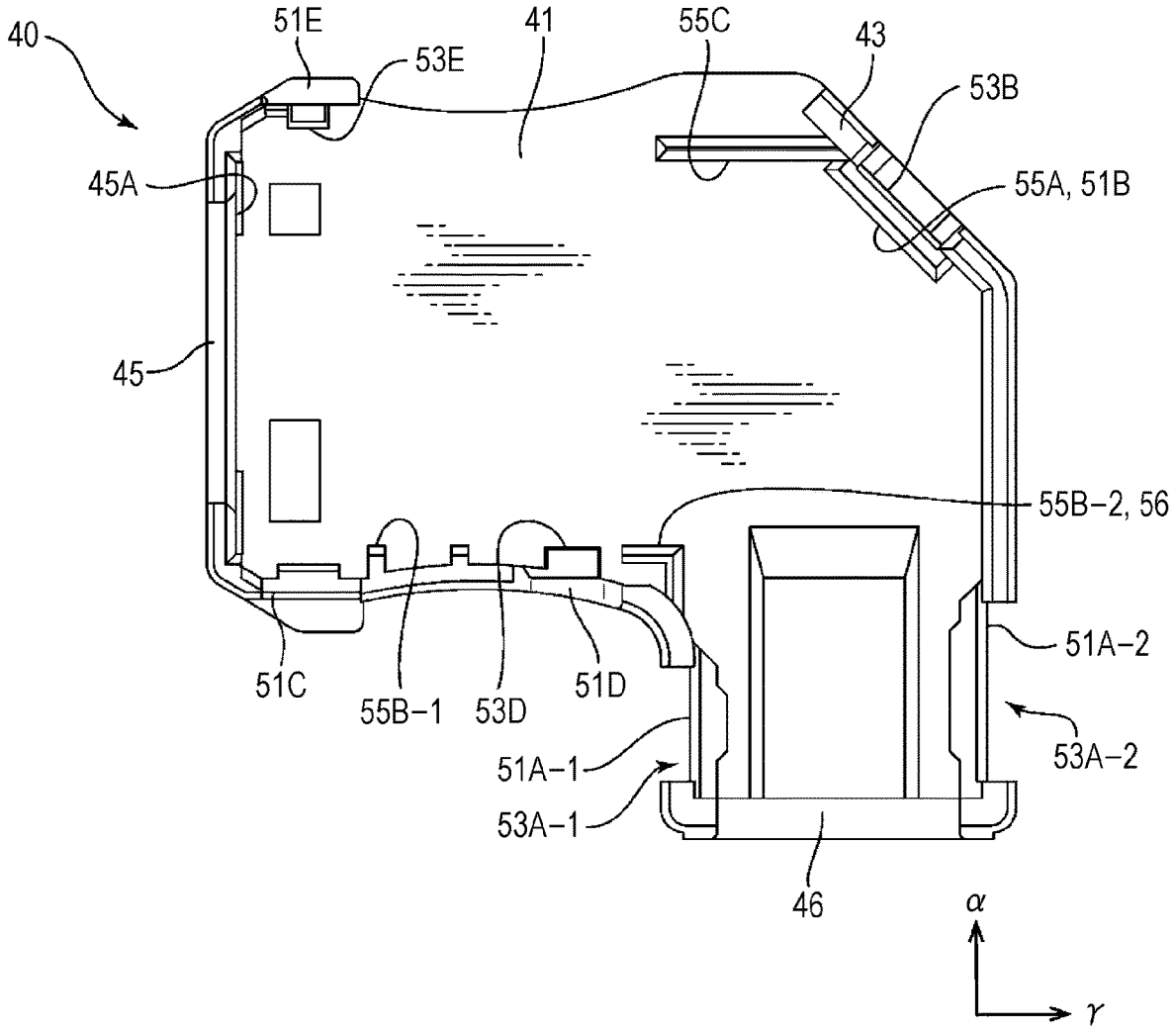
FIG. 10 is a plan view of an individual body diagram of a second cover part.
Figure 11:
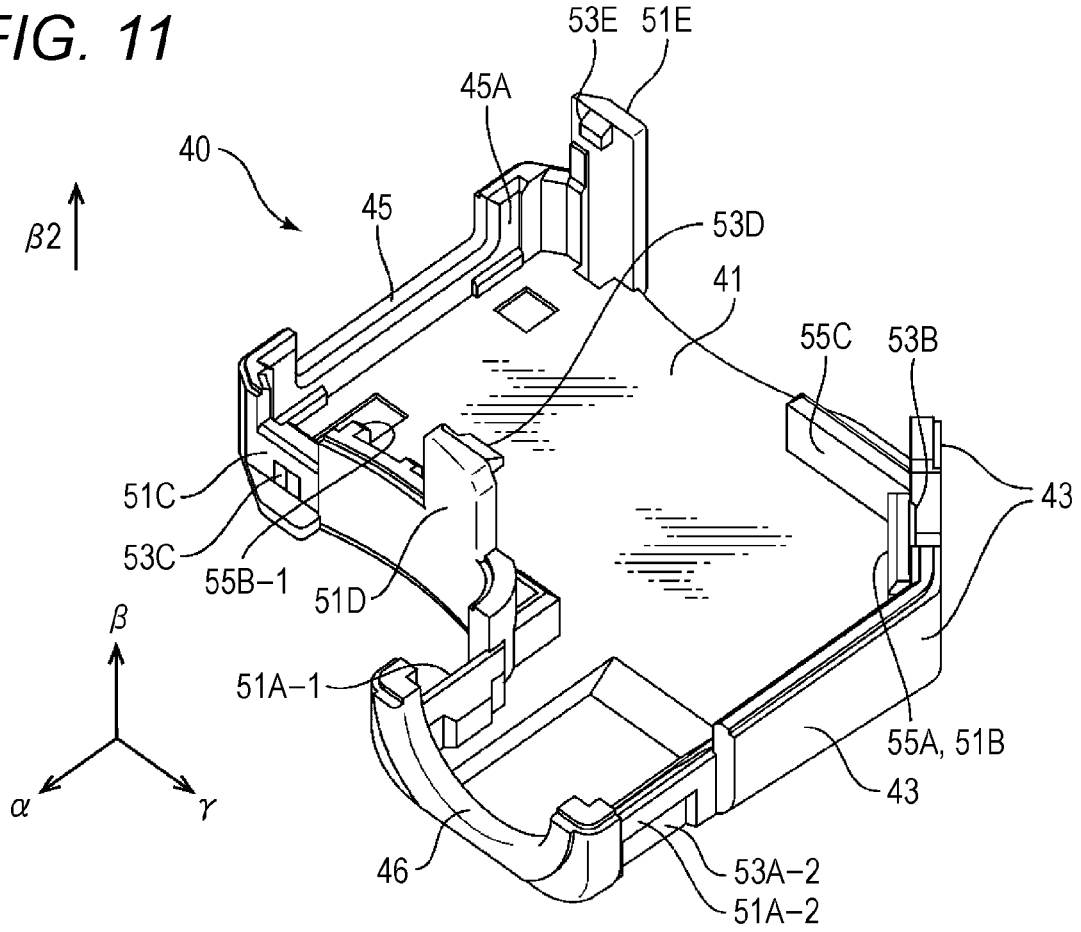
FIG. 11 is a perspective view of the individual body diagram of the second cover part.
Figure 12:
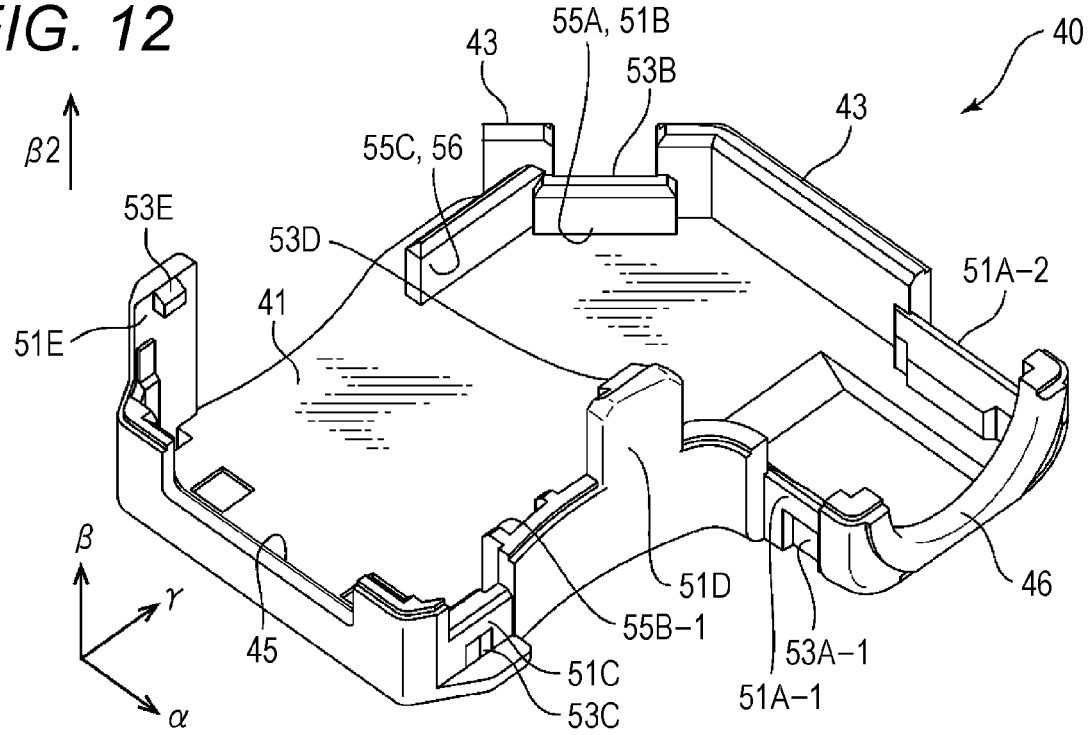
FIG. 12 is a perspective view of the individual body diagram of the second cover part.

FIG. 10 to FIG. 12 each illustrate an individual body diagram of the second cover part 40. FIG. 10 is a plan view of the second cover part 40 corresponding to FIG. 5 illustrating the first cover part 20. FIG. 11 and FIG. 12 are perspective views of the second cover part 40 corresponding to FIG. 6 and FIG. 7 illustrating the first cover part 20, respectively.

Figure 13:
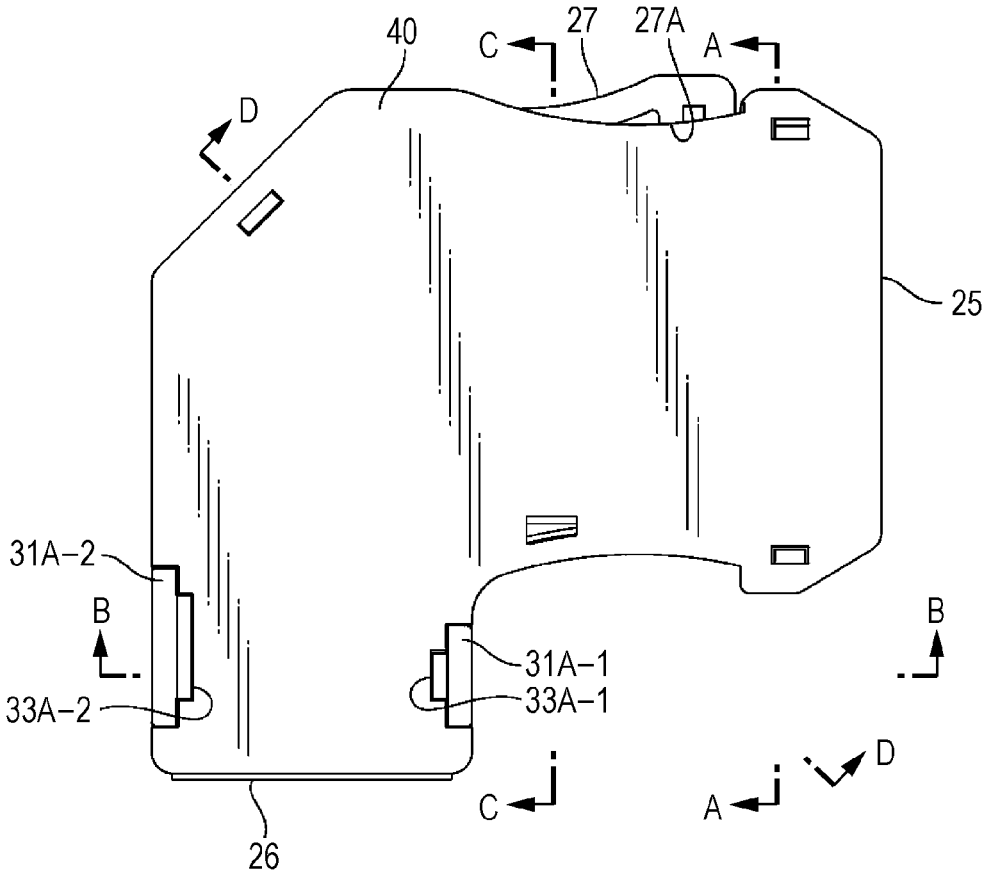
FIG. 13 is a plan view illustrating the state in which the second cover part is coupled with the first cover part.
Figure 14:
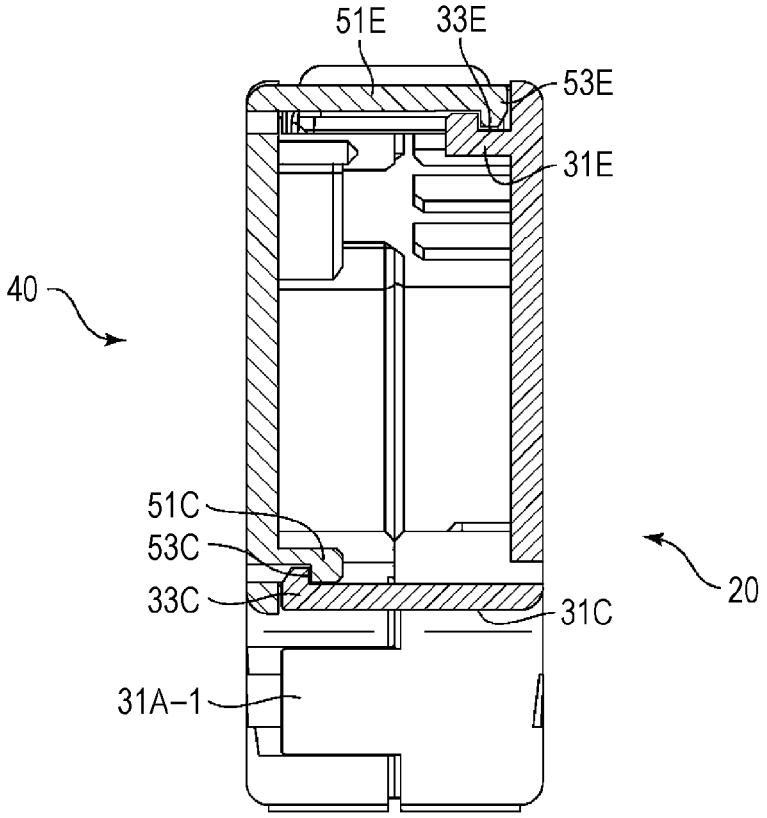
FIG. 14 is a cross-sectional view taken along line A-A in FIG. 13.
Figure 15:
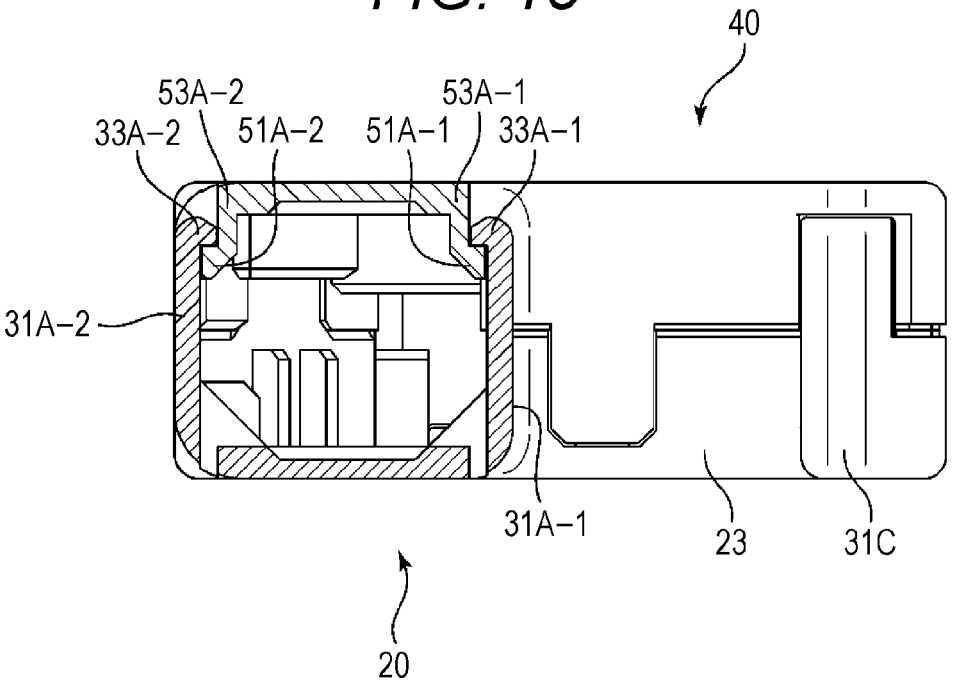
FIG. 15 is a cross-sectional view taken along line B-B in FIG. 13.
Figure 16:
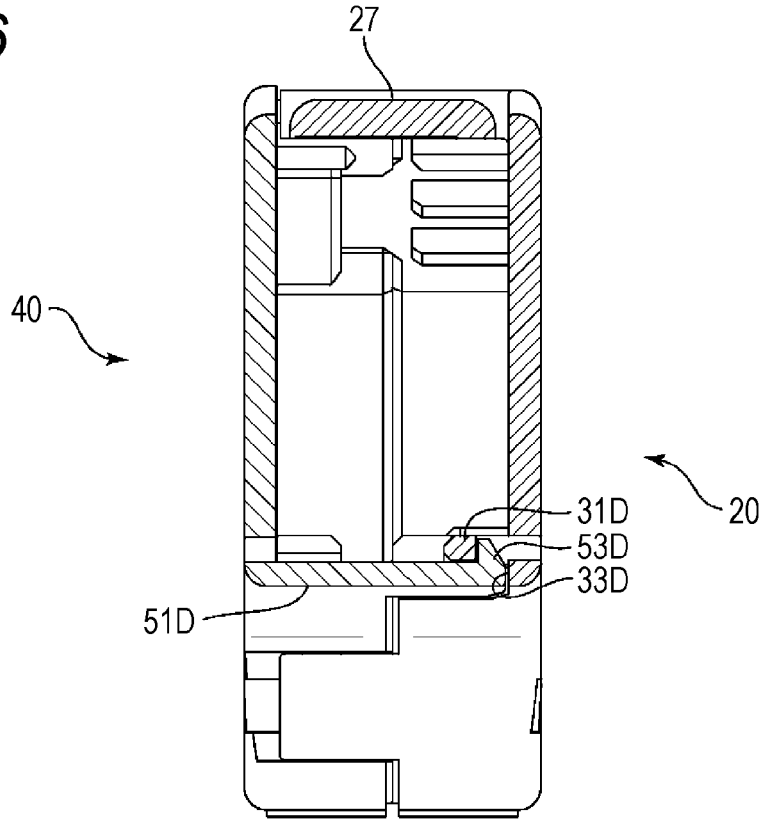
FIG. 16 is a cross-sectional view taken along line C-C in FIG. 13.
Figure 17:
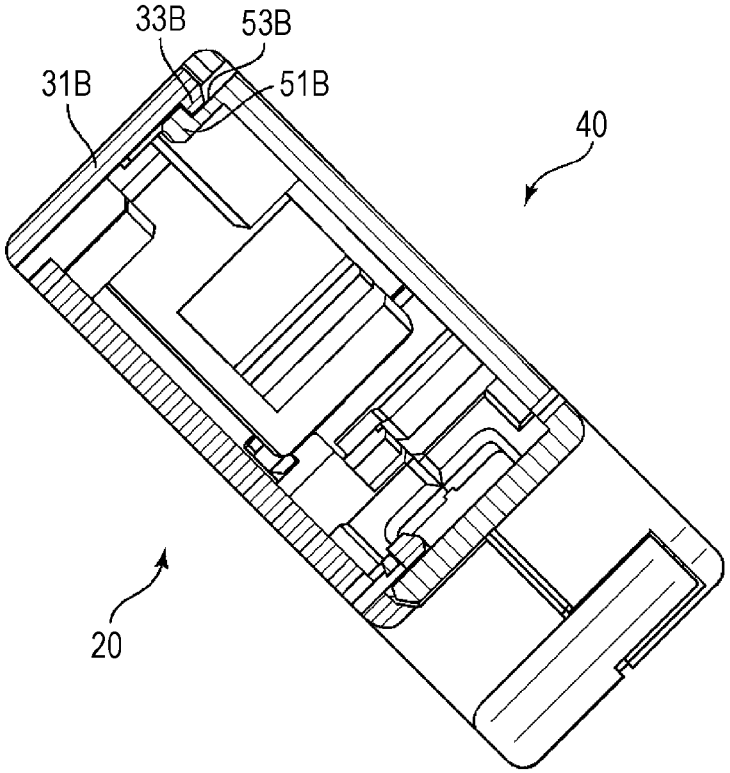
FIG. 17 is a cross-sectional view taken along line D-D in FIG. 13.

FIG. 13 is a plan view illustrating the state in which the second cover part 40 is coupled with the first cover part 20, and corresponds to FIG. 8 illustrating the first cover part 20. FIG. 14 to FIG. 17 are cross-sectional views taken along lines A-A, B-B, C-C and D-D in FIG. 13, respectively.

The second cover part 40 is preferably coupled with the first cover part 20 after the metal shell 10 is positioned relative to the first cover part 20 as illustrated in FIG. 8 and FIG. 9. By coupling the second cover part 40 in this manner, the work for coupling can be performed stably.

The second cover part 40 has a shape having a complementary relationship with the first cover part 20, and includes a plurality of elements corresponding to individual elements of the first cover part 20.

For example, corresponding to the mount surface 21 of the first cover part 20, the second cover part 40 include an opposite surface 41.

In addition, corresponding to the periphery wall 23 of the first cover part 20, the second cover part 40 includes a periphery wall 43. Furthermore, corresponding to the cable outlet 26 and connection port 25 of the first cover part 20, the second cover part 40 includes a cable outlet 46 and a connection port 45. Portions of the first cover part 20 forming the periphery wall 23 and portions of the second cover part 40 forming the periphery wall 43 have substantially approximately the same sizes in direction "β". For example, the cable outlet 26 of the first cover part 20 and the cable outlet 46 of the second cover part 40 each form an approximately half of the cover member 2 in direction "β" when the first cover part 20 and the second cover part 40 are combined together. Similarly, the connection port 25 of the first cover part 20 and the connection port 45 of the second cover part 40 also each form an approximately half of the cover member 2 in direction "β". Note that no members are provided at a portion of the second cover part 40 corresponding to the elastic piece 27 of the first cover part 20.

As has been explained already, the first cover part 20 includes, as the first engaging portion 31, the engaging element 31A (the pair of raised portions 31A-1 and 31A-2), the engaging element 31B, the engaging elements 31C and 31D, and the engaging element 31E. Corresponding to this, the second cover part 40 includes: an engaging element MA provided near the cable outlet 46; an engaging element 51B provided diagonally on the external-angle side of the crossing portion of exit direction "α" and connection direction "γ"; engaging elements 51C and 51D provided on the internal-angle side of the crossing portion such that the engaging elements 51C and 51D lie along connection direction "γ"; and an engaging element ME provided on the external-angle side of the crossing portion such that the engaging element ME lies along connection direction "γ".

These engaging elements MA to ME of the second cover part 40 have complementary relationships with the engaging elements 31A to 31E of the first cover part 20.

For example, the pair of raised portions 31A-1 and 31A-2 that is the engaging element 31A of the first cover part 20 is provided, the pair of raised portions 31A-1 and 31A-2 being raised from the mount surface 21 in direction "β1" toward the side on which the first cover part 20 is combined with the second cover part 40. Furthermore, the engaging protrusions 33A-1 and 33A-2 are provided to the raised portions 31A-1 and 31A-2, respectively. The engaging protrusions 33A-1 and 33A-2 are provided on the side of raised portions 31A-1 and 31A-2 on which the first cover part 20 is combined with the second cover part 40. Corresponding to this, the engaging element MA of the second cover part 40 is formed as a pair of engaging depressions 51A-1 and 51A-2. Furthermore, engaging depressions 53A-1 and 53A-2 are provided at parts of the pair of engaging depressions 51A-1 and 51A-2, respectively. When the first cover part 20 and the second cover part 40 are coupled together, the engaging protrusions 33A-1 and 33A-2 of the first cover part 20 fit to the engaging depressions 53A-1 and 53A-2, respectively. Similarly, the engaging protrusions 33B and 33C on the engaging elements 31B and 31C of the first cover part 20 also engage with engaging depressions 53B and 53C on the engaging elements 51B and 51C of the second cover part 40, respectively.

In addition, the engaging element 31D of the first cover part 20 has the engaging depression 33D. In addition, the engaging element 31D is provided as a depressed member on the side on which the second cover part 40 is combined with the first cover part 20. Corresponding to this, the engaging element MD of the second cover part 40 is provided as a member raised from the mount surface 51 in direction "β2" toward the side on which the second cover part 40 is combined with the first cover part 20. In addition, the engaging element MD has an engaging protrusion 53D on the side of the engaging element MD on which the second cover part 40 is combined with the first cover part 20. When the first cover part 20 and the second cover part 40 are coupled together, the engaging protrusion 53D of the second cover part 40 fits to the engaging depression 33D of the first cover part 20.

Similarly, the engaging depression 33E on the engaging element 31E of the first cover part 20 also engages with an engaging protrusion 53E on an engaging element ME of the second cover part 40.

The first cover part 20 also includes, as the abutting portions 35, the first abutting portion 35A, the second abutting portions 35B (35B-1 and 35B-2), and the third abutting portion 35C. Corresponding to this, the second cover part 40 includes: a first abutting portion 55A provided diagonally on the external-angle side of the crossing portion of exit direction "α" and connection direction "γ"; second abutting portions 55B (55B-1 and 55B-2) provided on the internal-angle side of the crossing portion and along the connection direction; and a third abutting portion 55C provided on the external-angle side of the crossing portion and along connection direction "γ".

Note that in the present embodiment, the first abutting portion 55A includes the same member as the engaging element 51B. The abutting portions 55A, 55B and 55C have corresponding abutting surfaces 56 formed to correspond to the abutting surfaces 36 provided on the abutting portions 35 of the first cover part 20. For example, a corresponding abutting surface 56 of the second abutting portion 55B-2 is illustrated in FIG. 10. In addition, a corresponding abutting surface 56 of the third abutting portion 55C is illustrated in FIG. 12. When the first cover part 20 and the second cover part 40 are combined together, the abutting surfaces 36 of the abutting portions 35 provided in the first cover part 20 can form a surface substantially continuous with the main body 11A together with the corresponding abutting surfaces 56 of the abutting portions 55A, 55B and 55C as corresponding abutting portions provided in the second cover part 40. The formation of the surface in this manner allows more stable positioning of the metal shell 10.

Still other aspects, features and effects of the technology of the present disclosure will become readily apparent by illustrating the particular embodiments and examples mentioned above including the best aspect intended to implement the technology of the present disclosure. In addition, the technology of the present disclosure can also be realized by configurations of other and different embodiments. Details of the embodiments can be modified from various apparent perspectives without departing from the sprit and scope of the technology of the present disclosure. Accordingly, the drawings and description are merely an illustration of the technology of the present disclosure. The technology of the present disclosure is not limited to such embodiments.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A cover member comprising:

a first cover part; and a second cover part, wherein the first cover part includes a mount surface on which a main body of a cable connector is mounted, a periphery wall which is provided to lie substantially along an outer edge of the main body of the cable connector mounted on the mount surface and which is raised from the mount surface toward a side on which the first cover part is combined with the second cover part, a cable outlet and a connection port that are provided as cutout portions of the periphery wall, an engaging portion that engages with a predetermined portion of the second cover part when the first cover part and the second cover part are combined together, and a pair of raised portions that is raised from the mount surface toward the side on which the first cover part is combined with the second cover part, the pair of raised portions being provided at positions which sandwich a cable extending out from the main body of the cable connector mounted on the mount surface and which are at or near the cable outlet, and an exit direction that lies along a direction of the cable that exits through the cable outlet, and a connection direction that lies along a direction of a counterpart connector to be connected with the main body of the cable connector through the connection port cross each other at the first cover part, the cable connector comprises the main body and a fitting portion protruding from the main body along the connection direction, the fitting portion comprising a movable engaging portion that engages with a predetermined portion of the counterpart connector when the cable connector is connected with the counterpart connector, the main body comprising an elastic movable piece that is connected with the movable engaging portion and manipulates the movable engaging portion, and the periphery wall of the first cover part comprises a cantilever-like elastic piece arranged at a portion where the elastic movable piece is positioned when the main body of the cable connector is mounted on the mount surface, the cantilever-like elastic piece comprising a pressing protrusion protruding toward the elastic movable piece to manipulate the elastic movable piece.

2. The cover member according to claim 1, wherein part of the engaging portion is formed as the pair of raised portions.

3. The cover member according to claim 2, wherein the pair of raised portions is provided continuously with the periphery wall from the mount surface toward the side on which the first cover part is combined with the second cover part.

4. The cover member according to claim 1, wherein the pair of raised portions has engaging protrusions which protrude toward opposite sides of the pair of raised portions, respectively, and which engage with predetermined portions of the second cover part, the engaging protrusions being provided on the side on which the first cover part is combined with the second cover part.

5. The cover member according to claim 1, wherein the cantilever-like elastic piece is provided on external-angle side of a crossing portion of the exit direction and the connection direction such that the cantilever-like elastic piece lies along the connection direction.

6. The cover member according to claim 1, wherein the engaging portion includes:

an engaging element provided near the cable outlet;

an engaging element provided diagonally on an external-angle side of a crossing portion of the exit direction and the connection direction;

engaging elements that are provided on an internal-angle side of the crossing portion such that the engaging elements lie along the connection direction; and an engaging element that is provided on the external-angle side of the crossing portion such that the engaging element lies along the connection direction.

7. The cover member according to claim 1, wherein a plurality of abutting portions abut against the main body of the cable connector when the main body of the cable connector is mounted on the mount surface, the plurality of abutting portions being provided in a gap that is formed, in a surface direction of the mount surface, between the periphery wall and the main body of the cable connector mounted on the mount surface.

8. The cover member according to claim 7, wherein the abutting portions include at least any one of: a first abutting portion provided diagonally on an external-angle side of a crossing portion of the exit direction and the connection direction; a second abutting portion provided on an internal-angle side of the crossing portion such that the second abutting portion lies along the connection direction; and a third abutting portion provided on the external-angle side of the crossing portion such that the third abutting portion lies along the connection direction.

9. The cover member according to claim 7, wherein the abutting portions have abutting surfaces that abut against the main body of the cable connector mounted on the mount surface, and when the first cover part and the second cover part are combined together, the abutting surfaces of the abutting portions form a surface substantially continuous with the main body of the cable connector together with corresponding abutting surfaces of corresponding abutting portions provided to the second cover part.

10. A cable connector device comprising:

the cable connector; and the cover member according to claim 1 that is provided to the cable connector.

11. A method of assembling a cable connector device, the method comprising:

mounting a main body of a cable connector on a mount surface of a first cover part, and sandwiching, with a pair of raised portions raised from the mount surface toward a side on which the first cover part is combined with a second cover part, a cable that extends out from the main body of the cable connector mounted on the mount surface; and combining the first cover part with the second cover part, and causing the first cover part and the second cover part to engage with each other, wherein the first cover part includes a periphery wall which is provided to lie substantially along an outer edge of the main body of the cable connector mounted on the mount surface when the main body of the cable connector is mounted on the mount surface, the periphery wall being raised from the mount surface toward the side on which the first cover part is combined with the second cover part, the cable connector comprises the main body and a fitting portion protruding from the main body along a connection direction that lies along a direction of a counterpart connector to be connected with the main body of the cable connector, the fitting portion comprising a movable engaging portion that engages with a predetermined portion of the counterpart connector when the cable connector is connected with the counterpart connector, the main body comprising an elastic movable piece that is connected with the movable engaging portion and manipulates the movable engaging portion, and the periphery wall of the first cover part comprises a cantilever-like elastic piece arranged at a portion where the elastic movable piece is positioned when the main body of the cable connector is mounted on the mount surface, the cantilever-like elastic piece comprising a pressing protrusion protruding toward the elastic movable piece to manipulate the elastic movable piece.

12. The method according to claim 11, further comprising:

positioning, relative to the first cover part, the main body of the cable connector by using the periphery wall; and causing the main body of the cable connector to abut against a plurality of abutting portions that fill a gap generated between the periphery wall and the main body of the cable connector mounted on the mount surface.

* * * * *